US005404614A

United States Patent [19]

Stephens

[11] Patent Number: 5,404,614

[45] Date of Patent: Apr. 11, 1995

[54] LATCH ASSEMBLY FOR BLOWER OF WET/DRY VACUUM CLEANER

[75] Inventor: Paul D. Stephens, Cleveland Heights, Ohio

[73] Assignee: Royal Appliance Mfg. Co., Cleveland, Ohio

[21] Appl. No.: 177,918

[22] Filed: Jan. 6, 1994

[51] Int. Cl.[6] ..... A47L 9/22

[52] U.S. Cl. ..... 15/327.2; 15/327.6; 15/328; 248/222.3; 403/349; 417/236; 417/360; 417/423.2; 417/423.15

[58] Field of Search ..... 15/327.1, 327.2, 327.6, 15/328; 417/236, 423.2, 423.15, 360; 403/349; 248/222.3; 415/213.1

[56] References Cited

U.S. PATENT DOCUMENTS

| | | | |
|---|---|---|---|
| D. 286,336 | 10/1986 | Berfield et al. . | |
| D. 305,816 | 1/1990 | Berfield et al. . | |
| 2,956,734 | 8/1953 | Doyle . | |
| 3,906,584 | 9/1975 | Hult . | |
| 4,125,339 | 11/1978 | Pittinger et al. | 248/222.3 X |
| 4,372,517 | 2/1983 | Welch et al. . | |
| 4,458,377 | 7/1984 | Frohbieter . | |
| 4,538,967 | 9/1985 | Furukawa . | |
| 4,538,971 | 9/1985 | Miller et al. . | |
| 4,735,555 | 4/1988 | Erickson, Jr. . | |
| 4,824,333 | 4/1989 | Erickson | 403/349 X |
| 4,836,753 | 6/1989 | Berfield et al. . | |
| 4,845,793 | 7/1989 | Meyer | 15/328 |
| 5,005,251 | 4/1991 | McLeod et al. | 15/328 X |
| 5,018,901 | 5/1991 | Ferree et al. | 403/349 |
| 5,118,254 | 6/1992 | Ellingson et al. | 403/348 X |
| 5,133,617 | 7/1992 | Sokn et al. | 403/349 |
| 5,183,982 | 2/1993 | Smith et al. . | |

FOREIGN PATENT DOCUMENTS

| | | |
|---|---|---|
| 1959087 | 5/1971 | Germany . |

*Primary Examiner*—Christopher K. Moore
*Attorney, Agent, or Firm*—Fay, Sharpe, Beall, Fagan, Minnich & McKee

[57] ABSTRACT

A quick attach-detach assembly of a wet-dry vacuum cleaner for selectively mounting an air blower on a lid includes a blower housing supporting a motor and a fan mounted to the motor and a lid to which the housing can be removably secured. The lid includes an aperture, an annular wall encircling the aperture and an annular ringlike surface defined on the wall. A retaining wall portion extends over a section of the ringlike surface to define a tunnel-shaped section. The blower housing includes a face on which is defined a protrusion. When the blower housing is mounted on the lid, the protrusion of the housing face is located adjacent the tunnel-shaped section. A locking ring is mounted on the lid for limited rotation thereon. A rotation of the ring selectively locks and unlocks the blower housing from the lid.

14 Claims, 5 Drawing Sheets

LATCH ASSEMBLY FOR BLOWER OF WET/DRY VACUUM CLEANER

BACKGROUND OF THE INVENTION

The present invention relates to latch mechanisms. More particularly, this invention relates to a latch mechanism for selectively securing a blower to a lid.

While the invention is particularly directed to the provision of a latch assembly which is employed to selectively attach or detach a blower from a lid secured to a bucket of a wet/dry vacuum cleaner, it should be appreciated by those of average skill in the art that the latch assembly could also be employed in a variety of other environments.

Known portable blowers have a blower housing with an impeller or fan in it that draws air into the housing and blows it through a directed outlet from the housing. Since the blower housing has an inlet, and suction necessarily develops at the inlet, the blower may be used to draw a vacuum, such as in a wet/dry vacuum cleaner, by being secured to the lid of such a cleaner.

It is known to attach a blower to the lid of a wet/dry vacuum cleaner by use of a bayonet mount. Such mounting necessitates the rotation of the blower in relation to the lid in order to secure the blower to the lid or to detach the blower from the lid. In the known type of device, the blower housing needs to be rotated by approximately 90 degrees in order to secure the blower to the lid. Such a large amount of rotation of the blower housing in relation to the lid is disadvantageous. It would be preferable not to have to rotate the blower housing at all in relation to the lid since the housing is somewhat cumbersome to rotate.

It is also known to secure a blower to the lid of a wet/dry vacuum cleaner through the use of tabs which are pivotally mounted to the lid and can be rotated to extend over a flange of the blower when it is desired to fasten the blower to the lid. In the known form of such devices, two pivotable tabs need to be rotated in order to latch the blower to the lid. This securing means is disadvantageous from two standpoints. First, two separate latching elements are necessary and each of these needs to be rotated in order to secure the blower to the lid. Second, since only two such tabs are provided, and these extend upwardly from the lid, they sometimes will be inadvertently contacted and could be rotated during use of the wet/dry vacuum cleaner thereby at least partially detaching the blower from the lid. It would be desirable to provide a single latching mechanism which only needs to be rotated a small distance in order to securely fasten a first member, such as a blower, to a second member, such as a lid.

Accordingly, it has been considered desirable to develop a new and improved latch mechanism which can be used, for example, to secure a blower to the lid of a wet/dry vacuum cleaner that would overcome the foregoing difficulties and others, and meet the above-stated needs, while providing better and more advantageous overall results.

BRIEF SUMMARY OF THE INVENTION

According to one aspect of the present invention, a quick attach-detach assembly for selectively mounting a body on a support means is provided.

More particularly in accordance with this aspect of the invention, the assembly comprises a housing including a face on which is defined a protrusion. A support member is provided to which the housing can be removably secured. The support member comprises an aperture, an annular wall encircling the aperture and an annular ringlike surface defined on the wall. A retaining wall portion extends over a section of the ringlike surface to define a tunnel-shaped section. The protrusion of the housing face is located adjacent to the tunnel-shaped section when the housing is mounted on the support member. A locking ring is mounted on the support member for limited rotation thereon. A rotation of the ring selectively locks and unlocks the housing from the support member.

Preferably, the locking ring further comprises a handle which can be grasped for rotating the locking ring. The support member can comprise an indented section in which the locking ring handle is located. Preferably, the locking ring comprises a protrusion. The locking ring protrusion extends over the housing protrusion when the locking ring is in its locked position and is spaced from the housing protrusion when the locking ring is in its unlocked position. Preferably, the protrusion of the locking ring is located in the tunnel-shaped section when the locking ring is in its unlocked position and is located outside the tunnel-shaped section when the locking ring is in its locked position such that it extends over the protrusion of the housing.

According to another aspect of the present invention, a detachable air blower and lid assembly are provided for a wet/dry vacuum cleaner.

More particularly in accordance with this aspect of the invention, the assembly comprises a blower housing for supporting a motor and a fan mounted to the motor. The blower housing includes a face on which are defined a plurality of circumferentially spaced protrusions. A lid is provided to which the blower housing can be removably secured. The lid comprises an indented central section, an annular surface defined in the lid and encircling the central section and a plurality of circumferentially spaced retaining wall sections extending over portions of the annular surface. Each of the plurality of blower housing protrusions is located adjacent a respective one of the plurality of retaining wall sections when the blower housing is mounted on the lid. A locking ring is mounted to the lid and is positioned over the annular surface for limited rotation in relation thereto. A rotation of the ring selectively locks and unlocks the blower housing from the lid.

In accordance with still a further aspect of the present invention, a wet/dry vacuum cleaner is provided.

More particularly in accordance with this aspect of the invention, the wet/dry vacuum cleaner comprises a bucket and a blower housing for supporting a motor and a fan mounted to the motor. The blower housing includes an intake shield on which are defined a plurality of circumferentially spaced protrusions. A lid can be selectively secured to the bucket and the blower housing can be removably secured to the lid. The lid comprises an indented central section, an annular surface defined in the lid and encircling the central section and a plurality of circumferentially spaced retaining wall sections each extending over a portion of the annular surface. Each of the plurality of blower housing protrusions is located adjacent a respective one of the plurality of retaining wall sections when the blower housing is mounted on the lid. A locking ring is mounted to the lid and is positioned on the ring for limited rotation thereon. A rotation of the ring selectively locks the blower housing to and unlocks the blower housing from the lid.

One advantage of the present invention is the provision of a new and improved locking or latching mechanism for selectively mounting a first member to a second member.

Another advantage of the present invention is the provision of a quick attach-detach assembly in which a first member can be simply moved axially into contact with a second member and then a locking ring mounted on one of the two members can be rotated to selectively secure the first and second members to each other.

Still another advantage of the present invention is the provision of a locking mechanism in which a locking ring is moved over a limited rotational distance to securely fasten a first member to a second member.

Yet another advantage of the present invention is the provision of a locking ring which is rotatably held in a member and can be selectively actuated by moving a handle of the locking ring to a limited angular extent.

A further advantage of the present invention is the provision of a detachable air blower and lid assembly in which the air blower is simply moved axially into and out of contact with the lid without any rotation taking place between the air blower and the lid and in which a single locking element is used to securely latch the blower to the lid.

A still further advantage of the present invention is the provision of a detachable air blower and lid assembly in which a blower housing is provided with a plurality of circumferentially spaced protrusions and a locking ring rotatably mounted to the lid is also provided with a plurality of circumferentially spaced protrusions which cooperate with the blower housing protrusions. The locking ring protrusions extend over the blower housing protrusions when the locking ring is in a locked position, in order to securely hold the blower to the lid. The two sets of protrusions are spaced from each other when the locking ring is in an unlocked position, in order to allow the blower to be axially lifted away from the lid.

Still other advantages and benefits of the present invention will become apparent to those skilled in the art upon a reading and understanding of the following detailed specification.

BRIEF DESCRIPTION OF THE DRAWINGS

The invention may take physical form in certain parts and arrangements of parts a preferred embodiment of which will be described in detail in this specification and illustrated in the accompanying drawings which form a part hereof and wherein.

DETAILED DESCRIPTION OF THE PREFERRED EMBODIMENT

Figure 1:
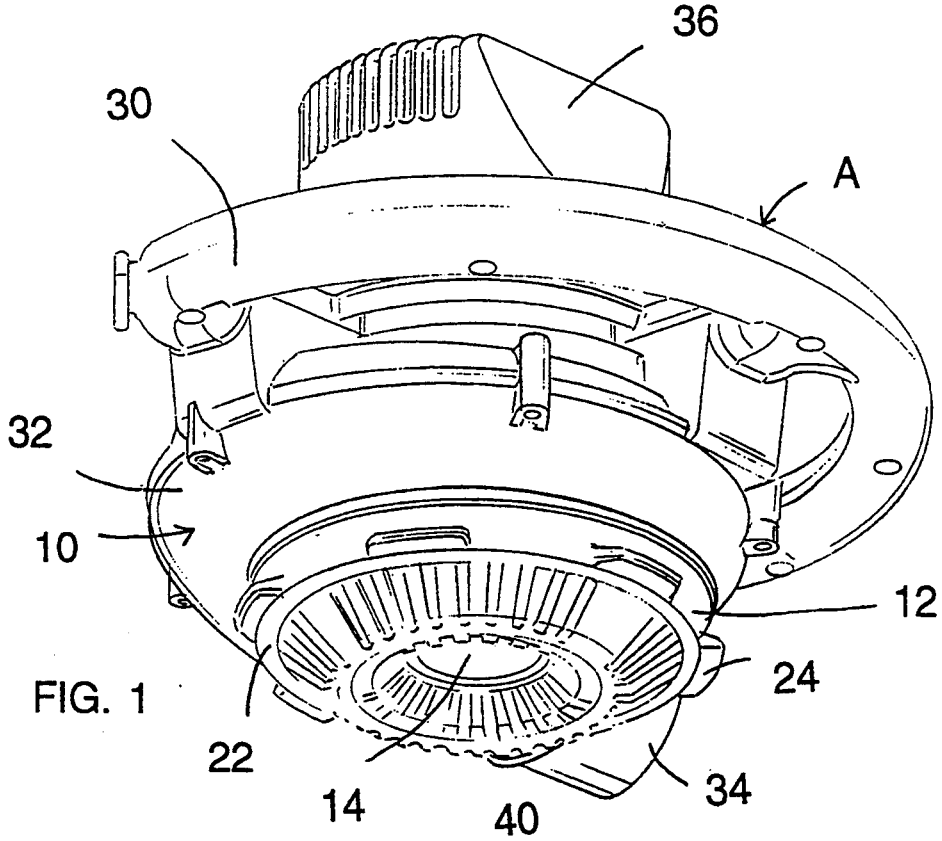
FIG. 1 is a perspective view of a blower according to the present invention.
Figure 2:
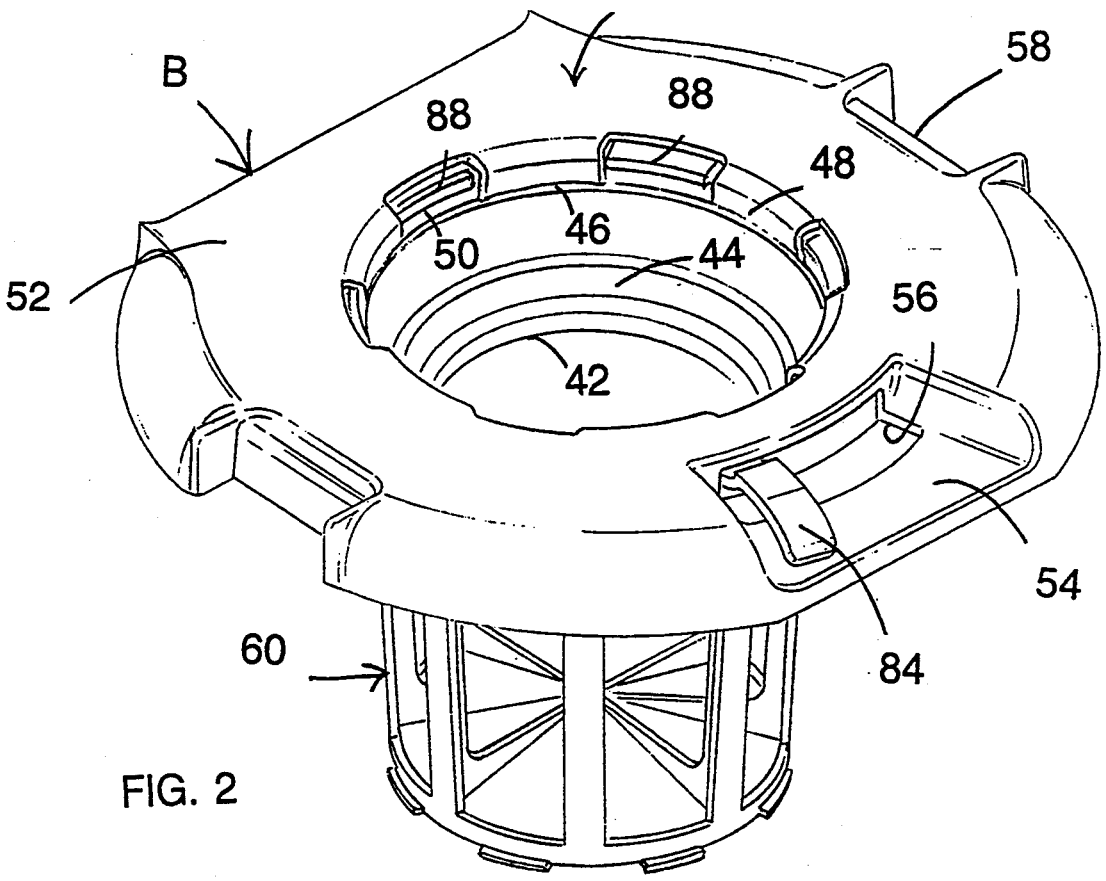
FIG. 2 is a perspective view of a lid according to the present invention.
Figure 6:
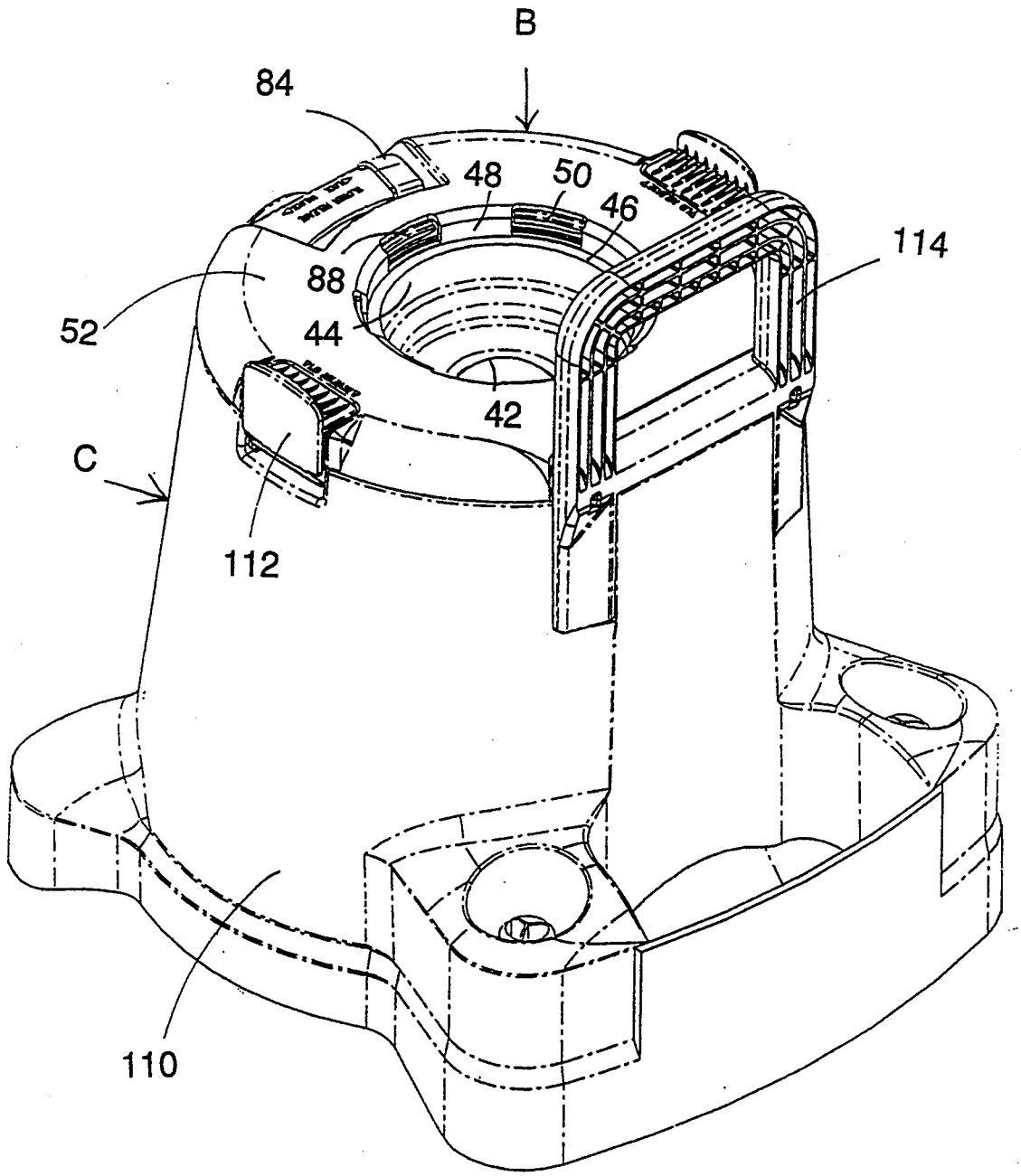
FIG. 6 is a reduced size perspective view of a wet/dry vacuum cleaner bucket to which the lid of FIG. 2 has been secured; and, FIG. 7 is a cross-sectional view of the bucket and lid of FIG. 6.

Referring now to the drawings wherein the showings are for purposes of illustrating a preferred embodiment of the invention only and not for purposes of limiting same, FIG. 1 shows a blower A which can be selectively mounted on and secured to a lid B illustrated in FIG. 2. The lid, in turn, can be selectively mounted on and secured to a bucket C of a wet/dry vacuum cleaner, as illustrated in FIG. 6. While the quick attach-detach assembly is illustrated herein as being used for selectively mounting an air blower to a lid of a wet/dry vacuum cleaner, it is evident that the quick attach-detach assembly disclosed herein could also be adapted for use in many other environments in which a first member is selectively secured to a second member.

Figure 4:
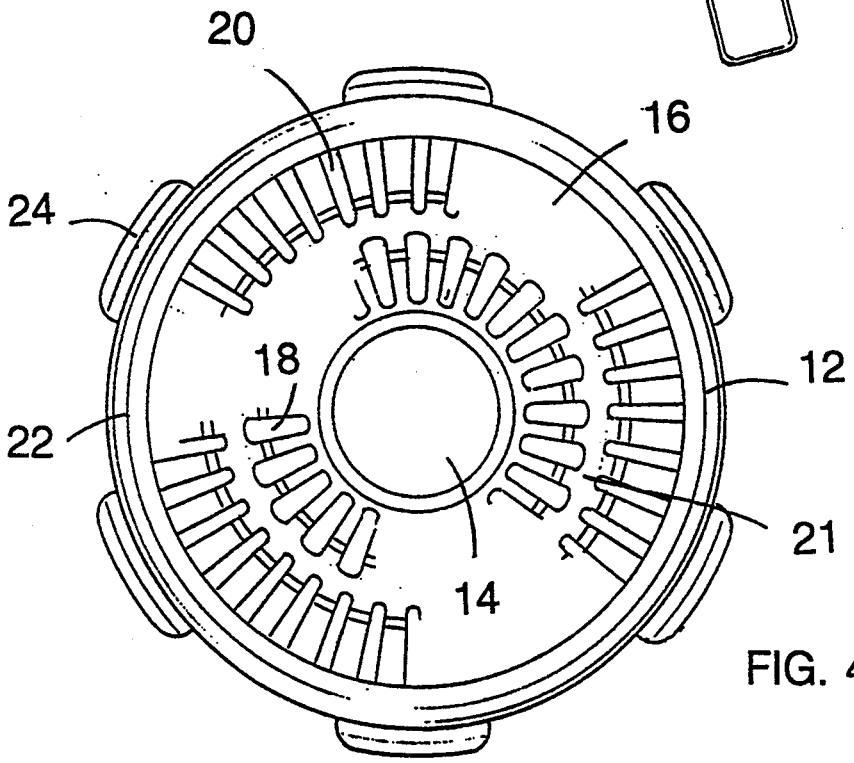
FIG. 4 is a bottom plan view of an air intake section of the blower of FIG. 1.

With reference now again to FIG. 1, the blower A according to the present invention comprises a housing 10 including an air intake section 12 having an indented central section 14 and a grill section 16. With reference now also to FIG. 4, the grill section 16 includes a first set of annularly disposed openings 18 positioned radially outwardly of the indented central section 14 and a second set of annularly disposed openings 20 positioned radially outwardly of the first set of openings 18. It is evident from FIG. 1 of the drawings that the grill has a contoured face such that an intermediate wall 21 between the two sets of openings 18 and 20 lies out of the plane of the indented section 14 such that the first set of openings 18 angle inwardly from the intermediate wall towards the indented section.

Located radially outwardly of the second set of openings 20 is an annular sealing rim 22 which lies substantially in the same plane as the central section 14. Thus, the second set of openings 20 angle away from the intermediate wall 21 towards the annular sealing rim 22. Extending radially outwardly of the annular sealing rim 22 are a plurality of spaced protrusions 24. The protrusions 24 are defined in the air intake section 12 such that they are preferably of one piece with it. Preferably, six such protrusions are located on the air intake section. Obviously, any other suitable number of protrusions could also be provided as may be considered desirable.

The blower A further comprises a handle 30, a fan housing 32 including an outlet 34 and a motor housing 36. These elements are meant to hold a fan preferably powered by an electric motor as is well known in the art. The fan and motor are not visible in FIG. 1 since these elements are encased in the fan housing 32 and motor housing 36 respectively.

Figure 7:
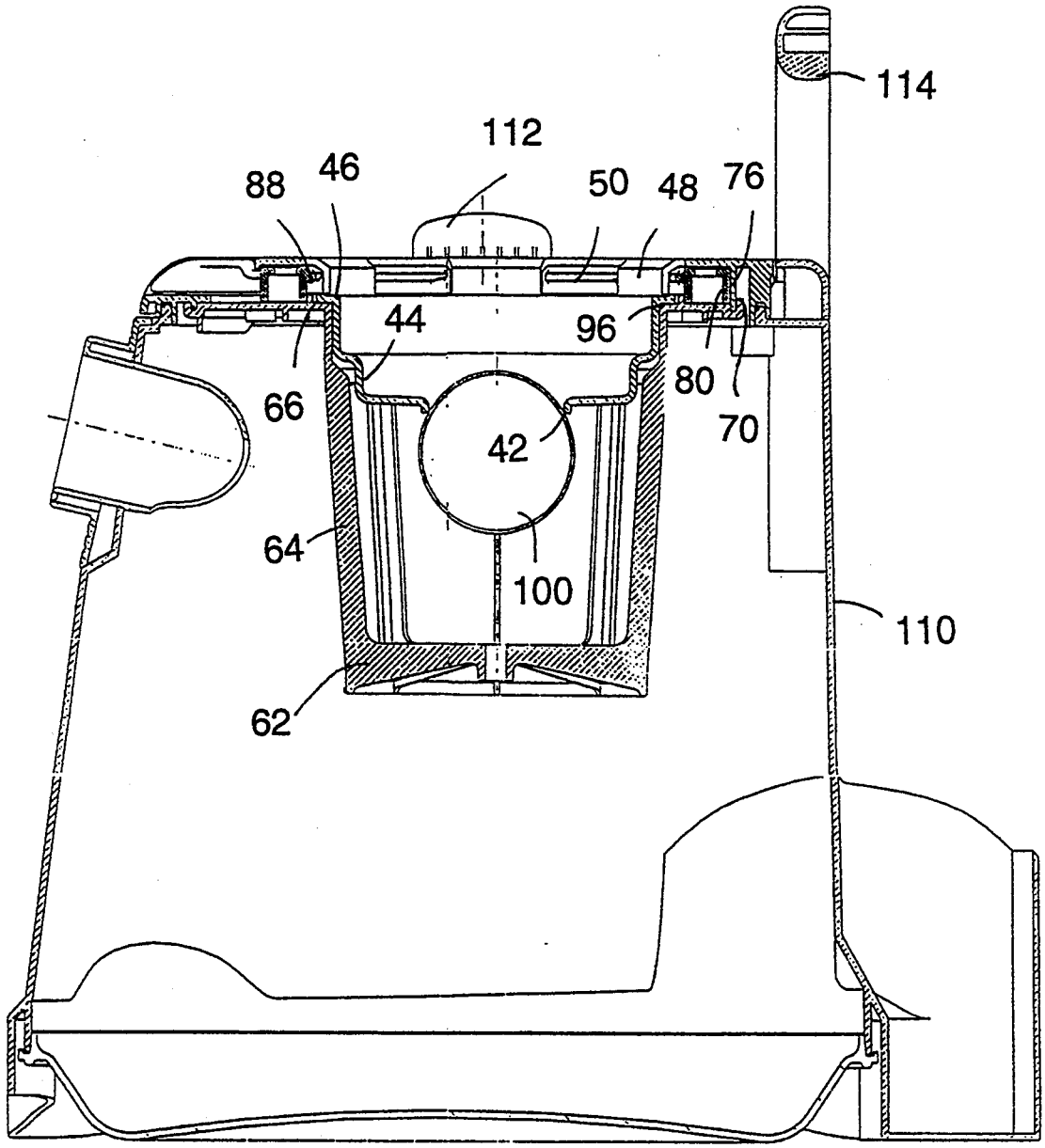

With reference now to FIG. 2, a lid B according to the present invention comprises a casing 40 in which is located a substantially centrally positioned axially extending aperture 42 defined in an indented section 44 of the casing. With reference now also to FIG. 7, the indented section 44 is stepped and is surrounded by an annular or ring-like surface 46. Extending over selected portions of the annular surface 46 are a plurality of spaced retaining wall portions 48. These define tunnel-shaped sections as is evident from FIG. 7. Defined between the tunnel-shaped sections are a plurality of slots 50. Preferably, six such tunnel-shaped sections and slots are provided on the lid.

Figure 5:
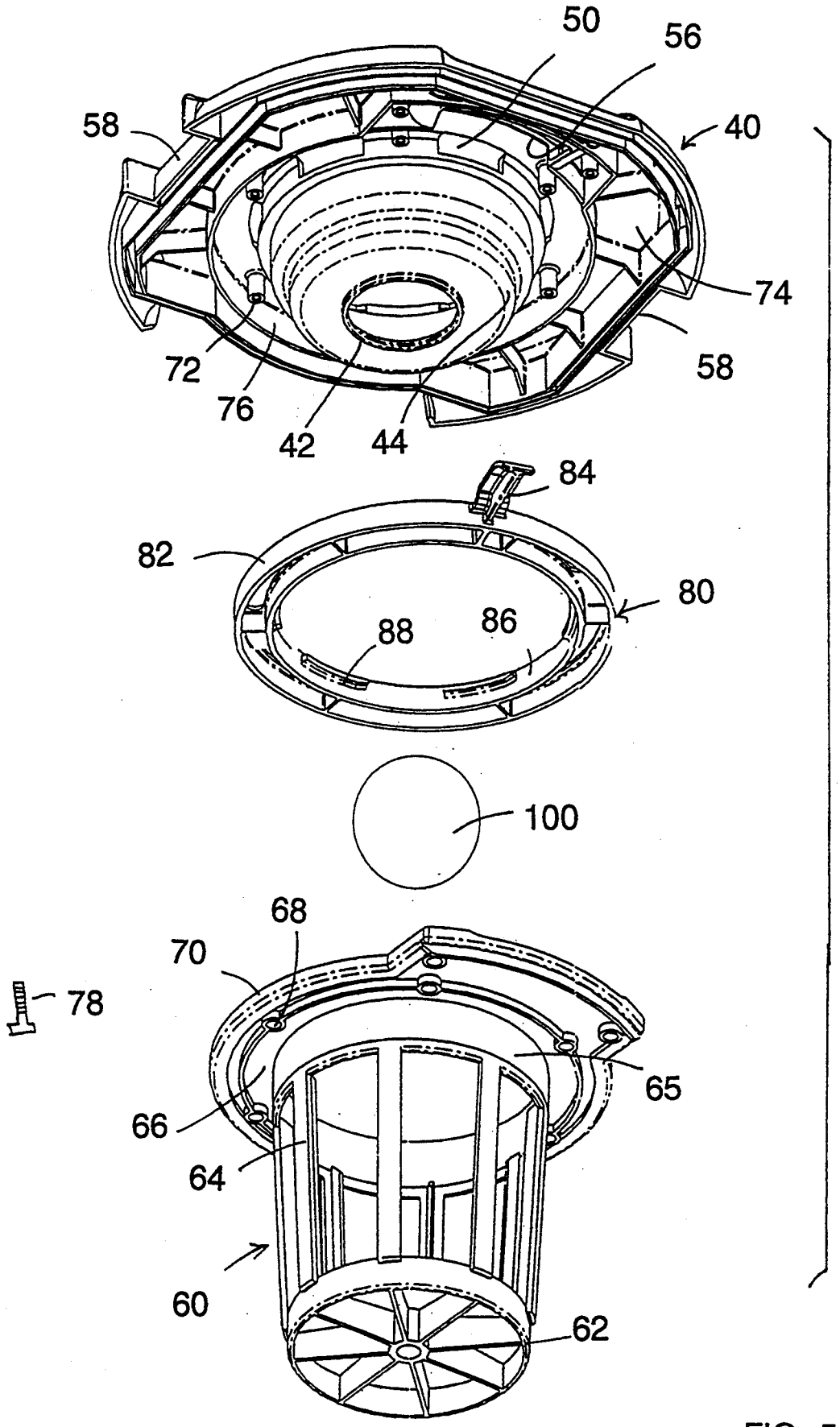
FIG. 5 is an exploded perspective view of the lid of FIG. 2.

With reference again to FIG. 2, the casing 40 further includes an upper surface 52 having an indented section 54 located along a radially outer portion thereof. Extending through the indented section 54 is a slot 56. A pair of spaced handle receiving apertures 58 are defined on opposing sides of the upper surface 52. Preferably, the casing 40 is manufactured of one piece such as by injection molding from a suitable plastic material, such as the thermoplastic polypropylene. Therefore, the retaining wall portions 48 which extend over sections of the annular surface 46 are formed of one piece with the annular surface, the casing upper surface 52 and the remainder of the casing. Secured to the lid 40 is a filter cage 60. With reference now to FIG. 5, the filter cage comprises a bottom wall 62 in which are provided a plurality of apertures. Secured to the bottom wall 62 are the lower ends of a plurality of spaced ribs 64 which extend substantially normal to the bottom wall so as to define a side wall of the filter cage. The ribs are each secured at their upper ends to an annular flange 65. A top wall 66 extends substantially normal to the flange 65. Defined on a bottom surface 67 of the top wall and extending therethrough are a plurality of spaced fastener receiving apertures 68. As best shown in FIG. 7, an annular flange 70 extends substantially normal to the outer periphery of the filter cage top wall 66.

The filter cage apertures 68 align with suitably positioned fastener stems 72 extending substantially normal to a bottom surface 74 of the lid 40. Located on the lid bottom surface radially outwardly of the plurality of spaced fastener stems 72 is a substantially annular flange 76 extending substantially normal to the lid bottom surface. Through the use of suitable conventional fasteners 78, the filter cage 60 can thus be secured to the lid 40.

Figure 3:
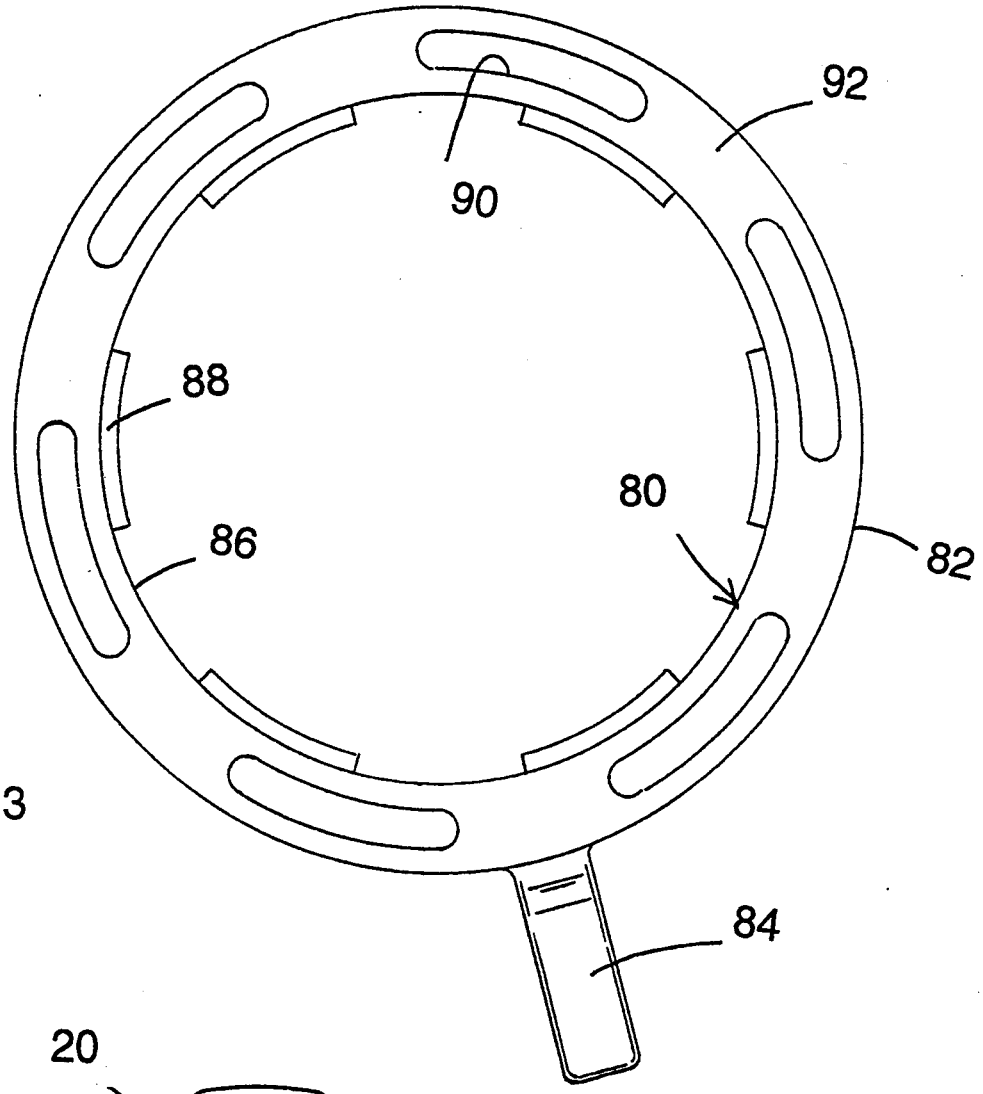
FIG. 3 is a top plan view of a locking ring rotatably mounted in the lid of FIG. 2.

A locking ring 80 is held between the filter cage 60 and the lid 40. With reference now to FIG. 3, the locking ring includes an outer periphery 82. Extending radially away from the outer periphery is a handle 84. The locking ring also has an inner periphery 86. Extending radially inwardly of the inner periphery are a plurality of spaced protrusions 88. The locking ring protrusions 88 are preferably of one piece with the inner wall. Preferably, six such protrusions are provided.

The locking ring also comprises a plurality of spaced slots or cutouts 90 extending over a top wall 92 which connects the inner periphery 86 with the outer periphery 82. Six such cutouts 90 are preferably provided. These are so shaped and positioned as to accommodate the fastener stems 72 extending from the bottom face 74 of the lid casing 40. When the locking ring is trapped between the lid casing 40 and the filter cage 60, the locking ring protrusions are positioned within the retaining walls or tunnel-shaped sections 48 of the lid 40 when the locking ring is in its unlocked position.

As is evident from FIG. 7, the locking ring 80 is located within the annular flange 76 defined on the casing bottom surface 74. The flange 76 contacts the annular flange 70 defined on the outer periphery of the top wall 66 of the filter cage 60 to provide a seal therebetween. A further annular seal is provided between the filter cage 60 and the lid casing 40 where these two elements contact each other as shown by the numeral 96 in FIG. 7.

It can be seen from FIG. 2 of the drawings that the handle 84 of the locking ring extends through the slot 56 provided on the casing upper surface 52 so that it overlies a portion of the indented section 54 thereof. As mentioned, the fastener stems 72 extend within respective ones of the slots 90 in the locking ring. They serve as end stops for the rotational motion of the locking ring. Also serving as end stops for the rotational motion of the locking ring in relation to the lid are the two ends of the indented section 54 of the casing upper surface.

Trapped between the filter cage 60 and the lid casing 40 is a suitable float 100 which can be in the shape of a ball as is illustrated in FIG. 7. As is well known in the art, the float 100 will selectively seal the aperture 42 when liquid in a bucket to which the lid B is attached rises to the level that the float 100 is advanced upwardly toward the aperture and is brought into sealing contact with the peripheral wall surrounding the aperture.

The lid B can be selectively secured on a bucket C such as used in a wet/dry vacuum cleaner. With reference now to FIG. 6, the bucket C can comprise a casing 110 having a pair of spaced latch handles 112, by which the lid B can be selectively secured in place, and an operating handle 114.

When the blower A is positioned axially over the lid B, it can be lowered onto the lid such that the protrusions 24 of the blower extend into the slots 50 defined on the lid. To this end, the protrusions 24 and slots 50 are suitably sized such that the protrusions can readily fit into the slots. When this occurs, the locking ring handle 84 can be moved from an open position to the position shown in FIGS. 2 and 6, i.e. the closed position. In the closed position, the locking ring protrusions slide over the blower protrusions to lock the blower A to the lid B. To unlock the blower from the lid, the handle 84 is rotated approximately 30 degrees towards the right in FIG. 2 so as to approach the opposite wall of the indented section 54. When this occurs, the locking ring protrusions 88 slide away from the blower protrusions 24 and thereby allow the blower to be separated from the lid.

As mentioned, the casing 40 of the lid is preferably manufactured from a suitable thermoplastic, such as polypropylene. The air intake section 12 of the blower A can similarly be suitably manufactured from a thermoplastic, such as polypropylene. In contrast, the locking ring 80 is preferably made from a dissimilar material, such as high density polyethylene (HDPE) or ABS. It is advantageous to manufacture the locking ring from a different thermoplastic material than the material of the lid B and the blower A so as to avoid squeaking when the locking ring 80 is rotated. In addition, manufacture of the locking ring from a dissimilar material insures that no friction bonding will take place between the locking ring and either the lid B or the blower housing A as the locking ring is rotated in relation to these two elements.

Sealing between the lid B and the blower housing A is accomplished by the mating annular surfaces 22 of the blower and 46 of the lid. This insures that air will not be drawn into the air intake 12 from the outside environment but only from within the bucket C. In order to prevent air from being drawn into the bucket C through the slot 56 on the lid B, the filter cage 60 seals against the lid casing 40.

It should be appreciated that only an axial movement of the blower A is necessary in relation to the lid B in order to position the blower on the lid or detach the blower from the lid. In other words, the blower need not be rotated in relation to the lid. The only rotation that takes place is a rotation of the locking ring 80 held in the lid B. That rotation is only over a limited arc, such as approximately 30 degrees. This construction makes it very simple either to attach the blower to the lid or detach the blower from the lid without having to rotate the blower in relation to the lid.

In contrast to the known blower and lid attachment systems, the present invention provides a single lever which only needs to be moved over a modest radial distance in order to securely latch the blower to the lid. Thus, no rotational maneuvering of the blower itself is necessary. Nor is there a need to manipulate a plurality of separate locking tabs. At the same time, a more secure latching is provided since, as mentioned, preferably six latching elements on the locking ring extend over the six protrusions on the blower air intake section to secure the blower in place to the lid.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

I claim:

1. A detachable air blower and lid assembly for a wet-dry vacuum cleaner, comprising:

a blower housing for supporting a motor and a fan mounted to the motor, said blower housing including a face on which are defined a plurality of circumferentially spaced protrusions;

a lid to which said blower housing can be removably secured, said lid comprising:

an indented central section, an annular surface defined in said lid and encircling said central section, a plurality of circumferentially spaced retaining wall sections extending over portions of said annular surface, wherein each of said plurality of blower housing protrusions is located adjacent a respective one of said plurality of retaining wall sections when said blower housing is mounted on said lid; and, a locking ring mounted to said lid and positioned over said annular surface for limited rotation in relation thereto, wherein a rotation of said ring selectively locks and unlocks said blower housing from said lid.

2. The assembly of claim 1 wherein said locking ring further comprises a handle which can be grasped for rotating said locking ring.

3. The assembly of claim 2 wherein said lid further comprises an indented section in which said locking ring handle is located.

4. The assembly of claim 1 wherein said housing face further comprises an annular surface located radially inwardly of said plurality of circumferentially spaced protrusions, said housing annular surface contacting a portion of said support member annular surface when said housing is secured to said lid.

5. The assembly of claim 1 further comprising a filter cage secured to said lid, wherein said lock ring is held between said filter cage and said lid.

6. The assembly of claim 6 further comprising a float positioned in said cage, said float confined between said cage and said indented section of said lid.

7. The assembly of claim 1 wherein said locking ring further comprises a plurality of circumferentially spaced protrusions, said locking ring protrusions extending over said blower housing protrusions when said locking ring is in a locked position and being spaced from said blower housing protrusions when said locking ring is in an unlocked position.

8. A wet-dry vacuum cleaner, comprising:

a bucket;

a blower housing for supporting a motor and a fan mounted to the motor, said blower housing including an intake shield on which are defined a plurality of circumferentially spaced protrusions;

a lid which can be selectively secured to said bucket and to which lid said blower housing can be removably secured, said lid comprising:

an indented central section, an annular surface defined in said lid and encircling said central section, a plurality of circumferentially spaced retaining wall sections each extending over a portion of said annular surface, wherein each of said plurality of blower housing protrusions is located adjacent a respective one of said plurality of retaining wall sections when said blower housing is mounted on said lid; and, a locking ring mounted to said lid and positioned on said lid for limited rotation thereon, wherein a rotation of said ring selectively locks said blower housing to and unlocks said blower housing from said lid.

9. The vacuum cleaner of claim 8 wherein said locking ring further comprises a plurality of circumferentially spaced protrusions, said locking ring protrusions extending over said blower housing protrusions when said locking ring is in a locked position and being spaced from said blower housing protrusions when said locking ring is in an unlocked position.

10. The vacuum cleaner of claim 8 wherein said locking ring further comprises a handle which can be grasped for rotating said locking ring.

11. The vacuum cleaner of claim 8 wherein said lid further comprises an indented section in which said locking ring handle is located.

12. The vacuum cleaner of claim 8 wherein said housing face further comprises an annular section located adjacent said at least one protrusion, said housing annular section contacting said lid annular section when said housing is secured to said lid.

13. The vacuum cleaner of claim 8 further comprising a filter cage secured to said lid, wherein said lock ring is held between said filter cage and said lid.

14. The vacuum cleaner of claim 13 further comprising a float positioned in said cage, said float being confined between said cage and said indented section of said lid.

* * * * *